US010283910B1

(12) United States Patent
Chen et al.

(10) Patent No.: US 10,283,910 B1
(45) Date of Patent: May 7, 2019

(54) ELECTRICAL CONNECTOR

(71) Applicant: SPEED TECH CORP., Taoyuan (TW)

(72) Inventors: Li-Sen Chen, Taoyuan (TW); Chu-Cheng Wu, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days.

(21) Appl. No.: 16/035,699

(22) Filed: Jul. 15, 2018

(30) Foreign Application Priority Data

Nov. 15, 2017 (TW) ..... 106217029 U

(51) Int. Cl.
*H01R 13/64* (2006.01)
*H01R 13/6461* (2011.01)
*H01R 13/405* (2006.01)

(52) U.S. Cl.
CPC ..... *H01R 13/6461* (2013.01); *H01R 13/405* (2013.01)

(58) Field of Classification Search
CPC ..... H01R 13/6461; H01R 13/6471
See application file for complete search history.

(56) References Cited

U.S. PATENT DOCUMENTS 7,481,657 B2 * 1/2009 Ng ..... H01R 13/516 439/637
7,585,184 B2 * 9/2009 Su ..... H01R 13/567 439/579
7,909,652 B2 * 3/2011 Yang ..... H01R 12/714 439/660
8,202,127 B2 * 6/2012 Zhang ..... H01R 24/60 439/660
8,342,886 B2 * 1/2013 Zhang ..... H01R 12/7005 439/660
8,353,726 B2 * 1/2013 Zhang ..... H01R 12/721 439/629
8,585,440 B2 * 11/2013 Jiang ..... H01R 13/6477 439/626
8,672,689 B2 * 3/2014 Tseng ..... H01R 12/62 439/493
8,694,709 B2 * 4/2014 Loffink ..... H01R 13/70 361/679.33
8,702,451 B2 * 4/2014 Luo ..... H01R 13/6471 439/607.28
8,740,631 B2 * 6/2014 Chen ..... H01R 12/62 439/76.1
8,758,030 B2 * 6/2014 Chen ..... H01R 12/77 439/493

(Continued)

*Primary Examiner* — Ross N Gushi
(74) *Attorney, Agent, or Firm* — CKC & Partners Co., LLC

(57) ABSTRACT

An electrical connector includes a first terminal group, an insulation body, a conductive glue, and an insulation casing. The first terminal group includes grounding terminals and signal terminals. Each of the terminals in the first terminal group has a main portion. The insulation body is fixed to the main portion of each terminal of the first terminal group. The insulation body has openings exposing corresponding grounding terminals. The conductive glue fills the openings of the insulation body, and the conductive glue electrically connects the grounding terminals. The insulation casing includes a first side wall which includes first terminal slots. The first terminal group is disposed in the first terminal slots of the first side wall, and the conductive glue is sandwiched between the first side wall and the insulation body.

10 Claims, 9 Drawing Sheets

(56) References Cited

U.S. PATENT DOCUMENTS 8,858,243 B2 * 10/2014 Luo ..... H01R 13/652 439/108
8,944,849 B1 * 2/2015 Yang ..... H01R 13/6588 439/607.07
9,077,118 B2 * 7/2015 Szu ..... H01R 24/00
9,236,689 B2 * 1/2016 Goh ..... H01R 13/6461
9,276,342 B2 * 3/2016 Masubuchi ..... H01R 12/775
9,281,589 B2 * 3/2016 Hsiao ..... H01R 4/04
9,301,415 B2 * 3/2016 Goodwin ..... H05K 7/1053
9,318,859 B2 * 4/2016 Chen ..... H01R 31/06
9,407,022 B1 * 8/2016 Wang ..... H01R 13/6275
9,409,331 B2 * 8/2016 Liu ..... H01R 12/725
9,490,585 B2 * 11/2016 Yang ..... H01R 13/6585
9,520,680 B2 * 12/2016 Hsu ..... H01R 13/658
9,564,714 B1 * 2/2017 Wang ..... H01R 13/6461
9,583,882 B1 * 2/2017 Hsueh ..... H01R 13/6471
9,590,358 B2 * 3/2017 Goh ..... H01R 12/716
9,640,915 B2 * 5/2017 Phillips ..... H01R 13/6471
9,653,848 B2 * 5/2017 Masubuchi ..... H01R 12/775
9,692,183 B2 * 6/2017 Phillips ..... H01R 13/6471
9,728,876 B1 * 8/2017 Shiue ..... H01R 12/725
9,742,118 B2 * 8/2017 Goh ..... H01R 13/6471
9,774,115 B1 * 9/2017 Liang ..... H01R 12/57
9,787,041 B1 * 10/2017 Ke ..... H01R 27/02
9,843,125 B2 * 12/2017 Tan ..... H01R 12/71
9,847,594 B2 * 12/2017 Zhang ..... H01R 13/506
9,881,650 B1 * 1/2018 Sotome ..... G11B 33/122
9,905,948 B1 * 2/2018 Yu ..... H01R 12/57
9,941,641 B1 * 4/2018 Jiang ..... H01R 13/6585
9,972,945 B1 * 5/2018 Huang ..... H01R 13/6585
10,148,031 B2 * 12/2018 Tan ..... H01R 12/71
10,193,267 B2 * 1/2019 Tan ..... H01R 13/514
2008/0188136 A1 * 8/2008 Su ..... H01R 13/567 439/660
2009/0068896 A1 * 3/2009 Zhang ..... H01R 12/7094 439/626
2010/0105249 A1 * 4/2010 Bandhu ..... H01R 13/6271 439/638
2011/0028045 A1 * 2/2011 Zhu ..... H01R 13/4361 439/660
2011/0076865 A1 * 3/2011 Luo ..... H01R 12/57 439/82
2011/0230101 A1 * 9/2011 Tang ..... H01R 13/6461 439/638
2012/0077389 A1 * 3/2012 Zhang ..... H01R 24/60 439/660
2012/0108109 A1 * 5/2012 Zhang ..... H01R 12/721 439/629
2012/0238145 A1 * 9/2012 Zhang ..... H01R 12/7005 439/660
2012/0282808 A1 * 11/2012 Luo ..... H01R 12/725 439/607.28
2013/0149882 A1 * 6/2013 Luo ..... H01R 13/652 439/108
2013/0288513 A1 * 10/2013 Masubuchi ..... H01R 12/775 439/386
2014/0004744 A1 * 1/2014 Hsu ..... H01R 13/658 439/626
2014/0080344 A1 * 3/2014 Castillo ..... H01R 13/405 439/327
2014/0162499 A1 * 6/2014 Goh ..... H01R 13/6461 439/630
2015/0031240 A1 * 1/2015 Yang ..... H01R 13/6471 439/607.08
2015/0255927 A1 * 9/2015 Goh ..... H01R 12/716 439/676
2016/0190746 A1 * 6/2016 Goh ..... H01R 13/6471 439/626
2016/0308314 A1 * 10/2016 Yu ..... H01R 24/60
2018/0076559 A1 * 3/2018 Tan ..... H01R 12/71

* cited by examiner

ELECTRICAL CONNECTOR

CROSS-REFERENCE TO RELATED APPLICATION

This application claims priority to Taiwan Application Serial Number 106217029, filed Nov. 15, 2017, which is herein incorporated by reference.

BACKGROUND

Field of Invention

The present invention relates to an electrical connector structure. More particularly, the present invention relates to an electrical connector that is capable of adjusting high-frequency signal transmission.

Description of Related Art

With the rapid development of technology, the amount of data transmission increases accordingly, and thus conventional transmission devices cannot meet the current high efficiency requirements. An early Small Computer System Interface (SCSI) has been modified to become a current Serial Attached SCSI (SAS) which has broken through the upper limit of the original transmission speed. The SAS technology continues to improve in research and development, and thus the transmission speed is increased to 24.0 Gbps, in which the SAS technology that supports and is compatible with Serial Advanced Technology Attachment (SATA) has a common and wide range of advantages.

In order to achieve the convenience of portability and to meet the requirements of thinness and shortness, components are designed to be miniaturized, and an electrical connector tends to be smaller. In order to prevent serious signal attenuation, a signal source transmits messages at a higher frequency band when the electrical connector is in the process of signal transmission. Due to the miniaturization design of the electrical connector, gaps between adjacent terminals transmitting signals are greatly shortened. Because transmitting signals at use the high-frequency frequency band, the two adjacent terminals are highly susceptible to mutual high-frequency noise interference, such as cross talk, impedance, propagation delay, propagation skew, and attenuation, thus causing the signal transmission process to be distorted or have errors, greatly reducing the transmission efficiency of the electrical connector.

In order to overcome the interference problem between the terminals, various connectors on the market are designed with metal grounding parts, in which the metal grounding parts are formed by stamping and bending, and are disposed in the connector. To reduce high-frequency interference between the signal terminals, grounding terminals are connected by the metal grounding parts. However, contact surfaces between the metal grounding parts and the grounding terminals may have gaps or different surface areas, thus resulting in poor grounding effects. In addition, the metal grounding parts require additional manufacturing processes, thus increasing the manufacturing cost and the production time. Therefore, these conventional connectors still need to be improved.

U.S. Pat. No. 9,281,589 provides a solution. Referring to FIG. 9, this patent reference discloses a connector A. The connector A includes terminals C and an insulation casing E. The insulation casing E includes an upper side wall E1, a lower side wall E2, and a chamber E3 which is sandwiched between the upper side wall E1 and the lower side wall E2, in which a groove B is formed on an outer surface of the upper sidewall E1 located away from the chamber E3, and the groove B has through holes B1 that pass through the upper sidewall E1 and expose grounding terminals. A conductive glue D is injected into the groove B. The conductive glue D fills the groove B and the through holes B1, and contacts the ground terminals of the terminals C until the conductive glue D is cured and shaped conformal the shape of the groove B and the through holes B1, and the conductive glue D has bumps D1. The bumps D1 of the conductive glue D and the grounding terminals electrically connected to each other making the grounding terminals are electrically shorted to each other, so as to improve high frequency interference of the connector A.

It can be seen from the above description that the conductive glue D is disposed on the outer surface of the insulation casing E located away from the chamber E3. The method of fixing the conductive glue D is to fill the groove B with the conductive glue D in a liquid state, and when the conductive glue D is cured, the conductive glue D is adhered to the groove B. The material composition of the insulation casing E is different from that of the conductive glue D, and the conductive glue D is fixed on the surface of the insulation casing E after the insulation casing E is formed. Because the groove B and the through holes B1 in the insulation casing E do not have designs for preventing the conductive glue D from falling off, the conductive glue D is very likely to fall off from the surface of the insulation casing E after the connector A has been used for several times, thus causing the connector A to have an incomplete structure which affects the quality and stability of signal transmission.

Since the conventional connectors have the defects affecting the transmission quality when the high-frequency signal is transmitted and cannot meet the actual industrial requirements, in order to improve the transmission quality and maximize the efficacy of the connector, an improvement for the structure of the connector design to solve the problem is greatly needed.

SUMMARY

The aspect of this disclosure is to design an electrical connector, in which the electrical connector includes conductive terminals forming terminal groups. The conductive terminals includes signal terminals and grounding terminals, in which each of the conductive terminals comprises a contact portion, a soldering portion, and a main portion connecting the contact portion and the soldering portion. An insulation body is fixed to each main portion of the conductive terminals of at least one terminal group. The insulation body has openings exposing corresponding grounding terminals. A conductive glue fills the openings of the insulation body, and the conductive glue electrically connects the grounding terminals. The grounding terminals are shorted through the conductive glue to enhance the shielding effect of the grounding terminals between the signal terminals and to reduce the crosstalk between the signal terminals.

Another aspect of this disclosure is to design an electrical connector, in which conductive terminals are disposed in terminal slots of an insulation casing, and the conductive glue is sandwiched between the insulation bodies and the insulation casing. The conductive glue is fixed in a groove of the insulation body by using the insulation casing, such that the conductive glue is firmly fitted to the insulation body. The conductive glue filling the openings is electrically connected to the grounding terminals, thereby preventing the conductive glue from falling off, thus maintaining the quality of signal transmission.

This disclosure provides an electrical connector to achieve the above objects. The electrical connector includes conductive terminals including signal terminals and grounding terminals, in which each of the conductive terminals includes a contact portion, a soldering portion, and a main portion connecting the contact portion and the soldering portion, and the conductive terminals include a first terminal group and a second terminal group. Insulation bodies includes a first insulation body and a second insulation body, in which the first insulation body is fixed to each main portion of the first terminal group, the second insulation body is fixed to each main portion of the second terminal group, and the insulation bodies has openings exposing the corresponding grounding terminals. A conductive glue is fixed in the openings of the insulation bodies such that the grounding terminals are electrically connected to each other. An insulation casing includes a first side wall, a second side wall and a bottom defining a abutting cavity, in which the first side wall and the second side wall are respectively located on two sides of the abutting cavity which are not adjacent to each other; the side walls includes terminal slots; the terminal slots include first terminal slots disposed on the first side wall and second terminal slots disposed on the second side wall; the bottom has at least one notch communicating with the terminal slots; the first terminal group is disposed on the first terminal slots of the first side wall; the second terminal group is disposed on the second terminal slots of the second side wall; and the insulation bodies are fixed to the notch corresponding to the bottom.

In order to further understand the features, characteristics and technical contents of this disclosure, refer the following detailed description of the disclosure and the accompany drawings. However, the accompany drawings are provided for reference only and are not to limited the present disclosure.

BRIEF DESCRIPTION OF THE DRAWINGS

The invention can be more fully understood by reading the following detailed description of the embodiment, with reference made to the accompanying drawings as follows:

FIG. 4-1 is a cross-sectional view of portions of components of the embodiment of the present disclosure;

FIG. 4-2 is a cross-sectional view of portions of components of the embodiment of the present disclosure;

FIG. 5-1 is a cross-sectional view of portions of components of the embodiment of the present disclosure;

FIG. 5-2 is a cross-sectional view of portions of components of the embodiment of the present disclosure;

DETAILED DESCRIPTION

Figure 1:
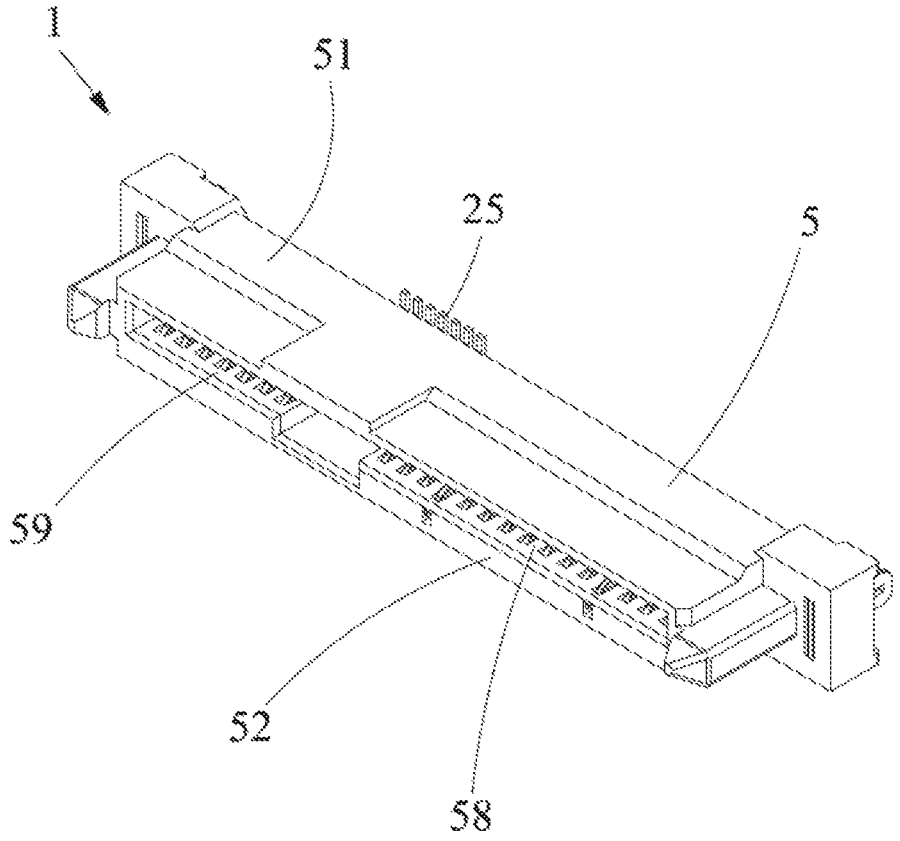
FIG. 1 is a perspective view of an embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

As shown in FIG. 1, an embodiment of the present disclosure discloses a high-frequency transmission electrical connector 1. The electrical connector 1 includes conductive terminals 2, insulation bodies 3, a conductive glue 4, and an insulation casing 5. The electrical connector 1 may be fixed on a circuit board (not shown), and may be docked with a docking device (not shown).

Figure 2:
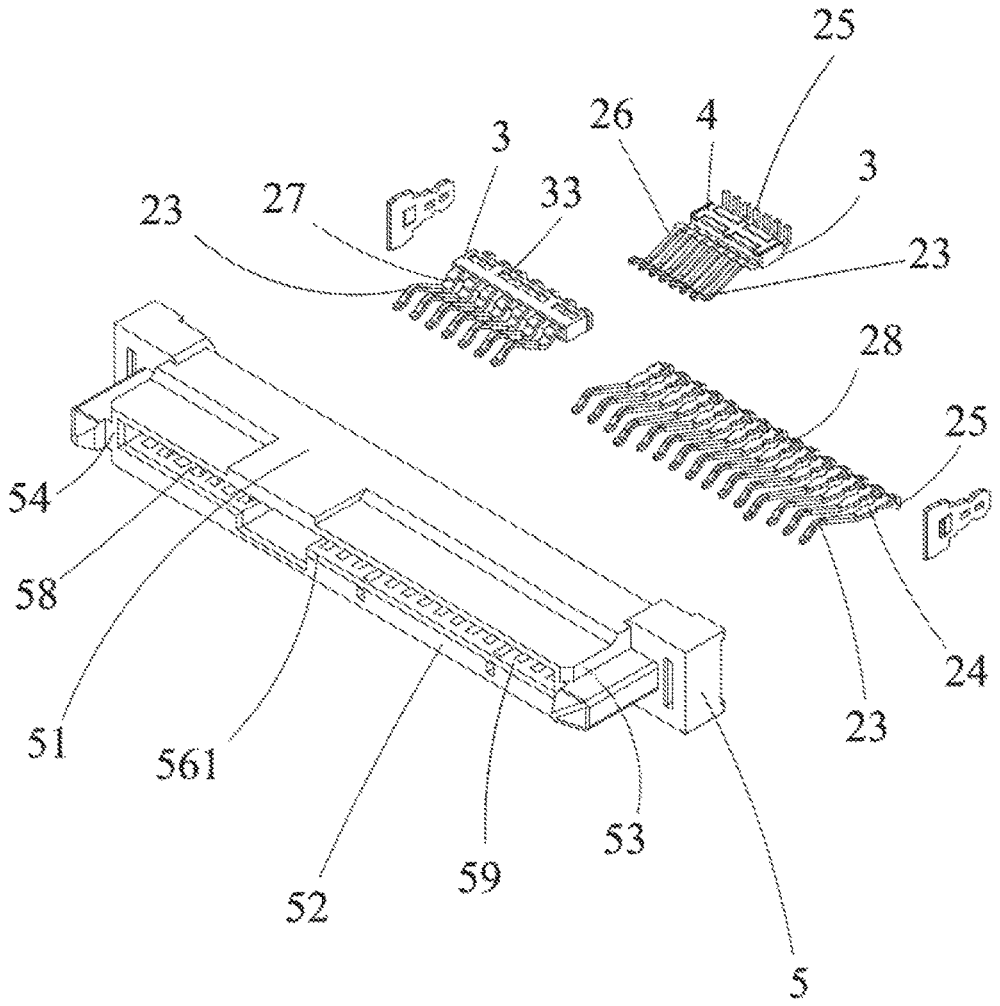
FIG. 2 is an exploded view of the embodiment of the present disclosure.
Figure 3:
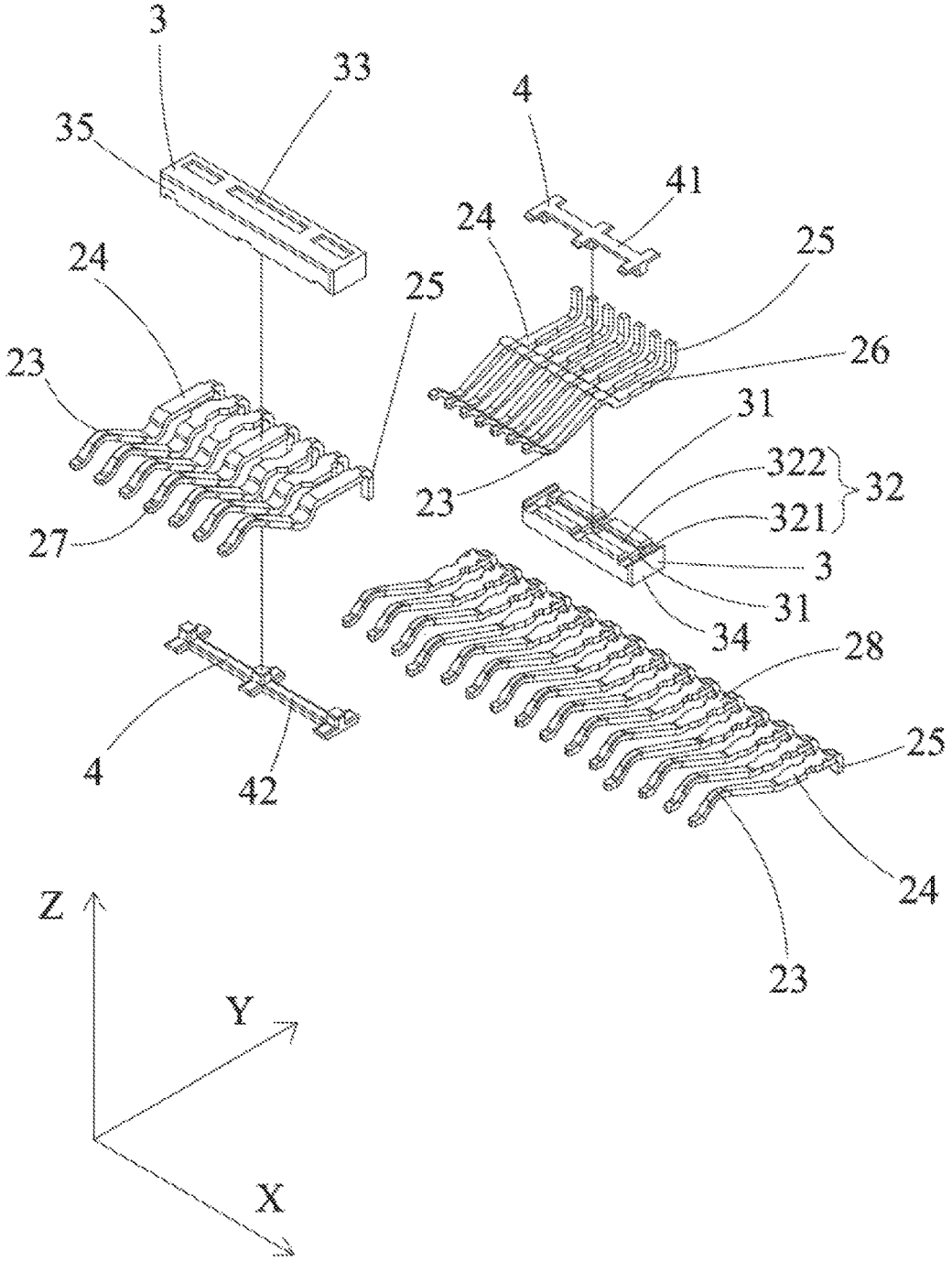
FIG. 3 is an exploded view of portions of components of the embodiment of the present disclosure.

In an embodiment of the present disclosure, as shown in FIG. 2 and FIG. 3, the conductive terminals 2 of the electrical connector 1 include signal terminals 21 and grounding terminals 22. Each of the conductive terminals 2 includes a contact portion 23, a soldering portion 25, and a main portion 24 connecting the contact portion 23 and the soldering portion 25. The conductive terminals 2 are arranged side by side to form a first terminal group 26, a second terminal group 27, and a third terminal group 28. The width of the conductive terminals 2 is defined by the thickness of the conductive terminals 2 in the side-by-side arrangement direction. As shown in FIG. 3, the width of the conductive terminal 2 is defined by the thickness of between the opposite surfaces of each of the conductive terminals 2 perpendicular to an X-axis direction, in which each of the main portions 24 and its corresponding contact portion 23 include at least one inclined surface therebetween. Through the inclined surface, the width of the main portions 24 is gradually decreasing to the width of the contact portions 23, thereby preventing an abrupt change in electrical characteristics. The width of each of the contact portions 23 is smaller than the width of each of the main portions 24, such that the distances between the contact portions 23 of most of the conductive terminals 2 are greater than the distances between the main portions 24. The cross-sectional areas of the contact portions 23 are smaller than the cross-sectional areas of the main portions 24. Accordingly, when the conductive terminals 2 are connected to the docking device, due to the increase of the distance between the adjacent contact portions 23 or the decrease of the areas of two adjacent opposite surfaces of the contact portions 23, the capacitance effect between the conductive terminals 2 is reduced and the interference between the conductive terminals 2 is improved.

The electrical connector 1 is used for transmitting high-frequency signals. If the conventional transmission structure is adopted, cross talk and other high-frequency interference problems are likely to occur between two adjacent signal terminals 21, thus affecting the accuracy and efficiency of signal transmission. In order to overcome this problem, the signal terminals 21 transmit high-frequency signals by specifically using differential signal pairs. Each of the differential signal pairs use two signal terminals 21 to transmit the differential signal at the same time, in which the amplitude of the two signals of the differential signal is the same, but the phases thereof are opposite, such that interference can be effectively canceled. With this data transmission method, electromagnetic interference can be effectively suppressed and timing sequence is accurate, thereby improving the quality and efficiency of signal transmission. In order to avoid interference between two pairs of differential signal terminals, the grounding terminals 22 are respectively designed on two outer sides of the differential signal terminal pair, and the grounding terminals 22 separate the two adjacent sets of the differential signal terminal pairs. The grounding terminals 22 can absorb and ground the interference noise generated by the differential signal terminal pairs, and can effectively shield the differential signal terminal pairs from interference. Therefore, the conductive terminals 2 are arranged in the order of ground-signal -signal -ground (G-S-S-G), so as to achieve better high frequency signal transmission efficiency.

In the embodiment of the present disclosure, the insulation bodies 3 are respectively fixed to the main portions 24 of at least one terminal group by insert molding. In this embodiment, the insulation bodies 3 include a first insulation body 34 and a second insulation body 35. The first insulation body 34 is fixed to each main portion 24 of the conductive terminals 2 of the first terminal group 26. The second insulation body 35 is fixed to each main portion 24 of the conductive terminals 2 of the second terminal group 27. The insulation bodies 3 have openings 31. The openings 31 may or may not pass through the insulation bodies 3. The openings 31 respectively expose the grounding terminals 22 covered by the insulation bodies 3. The insulation bodies 3 have at least one channel 32, and the channel 32 is a groove structure formed on the surfaces of the insulation bodies 3. The openings 31 are respectively located on the surface of the insulation body 3 in the channel 32. At least one surface of each insulation body 3 includes the openings 31 and the channel 32. The channel 32 includes parallel sections 321 and a vertical section 322. The openings 31 are respectively located in the parallel sections 321, and each opening 31 is corresponding to a parallel section 321, and the parallel section 321 is parallel to the extending direction of the conductive terminals 2. The vertical section 322 is connected to the parallel sections 321, and the vertical section 322 is perpendicular to the extending direction of the conductive terminals 2. The insulation bodies 3 have the parallel sections 321 and the vertical section 322 to increase the contact surface are of the channels 32, thereby enhancing the bonding strength between the conductive glue 4 and the insulation bodies 3.

In the embodiment of the present disclosure, referring to FIGS. 3, 4, 4-1, 4-2, 5, 5-1 and 5-2 which are cross-sectional views of the first terminal group 26 and the second terminal group 27. The conductive glue 4 includes a first conductive portion 41 and a second conductive portion 42, in which the first conductive portion 41 is mounted on the first insulation body 34, and the second conductive portion 42 is mounted on the second insulation body 35. The conductive glue 4 is fixed on the openings 31 and the channel 32 of the surface of the insulation body 3, in which the conductive glue 4 can be respectively fixed by filling or assembling. The channels 32 provide space for accommodating the conductive glue 4. The conductive glue 4 fill in each of the openings 31 and the conductive glue 4 electrically connect the grounding terminals 22 exposed through the openings 31. The conductive glue 4 is connected to the grounding terminals 22 across the signal terminals 21 in the form of a bridge. When the conductive glue 4 is applied and molded, the liquid conductive glue 4 is injected into the channel 32 and the openings 31 on the surfaces of the insulation bodies 3, such that the conductive glue 4 is in physical contact with the grounding terminals 22. After the filling operation is completed, the conductive glue 4 may be changed from a liquid state to a solid state by heat curing or room temperature curing, such that the conductive glue 4 is fixed in the channel 32, and the grounding terminals 22 are electrically connected by the conductive glue 4. If the conductive glue 4 is assembled, the conductive glue 4 is molded to conform to the structure of the openings 31 and the channel 32 at first, and then the cured structure of the conductive glue 4 is fixed in the openings 31 and the channel 32 in a manner of stamping or assembly. The structure of the conductive glue 4 is not limited to being in electrical contact with the grounding terminals 22, but can be electromagnetically connected with the grounding terminals 22 at a tiny distance. The conductive glue 4 is used to provide the function of electrically balancing the ground terminals 22. The potential of each of the ground terminals 22 is adjusted. When one of the ground terminals 22 receives a large interference, the conductive glue 4 can transmit the noise to the other ground terminals 22, so as to maintain the shielding effect of the ground terminals 22.

The conductive glue 4 is mainly composed of matrix resin, conductive filler and dispersant. The matrix resin may include an adhesive system such as an epoxy resin, an organic silicone resin, a polyimide resin, a phenol resin, a polyurethane, an acrylic resin, etc. The conductive filler may include powders of Au, Ag, Cu, Al, Zn, Fe, Ni, and Graphite, and the conductive filler is composed of one or more of the aforementioned elements and some conductive compounds. The particle size of the conductive filler powder has to meet the appropriate size that can be added to the matrix resin and can be allowed a dispersant to be added therein, such that the conductive filler powder may be evenly distributed in the matrix resin to achieve the effect of uniform conductivity. The curing temperature of the conductive glue 4 is generally lower than the soldering temperature. The conductive glue 4 can be used to replace solder, thereby reducing the damage of the electronic components caused by the high temperature of the soldering operation, and the technology of using the conductive glue 4 is simple and easy to be operated, thereby improving the production efficiency.

Figure 6:
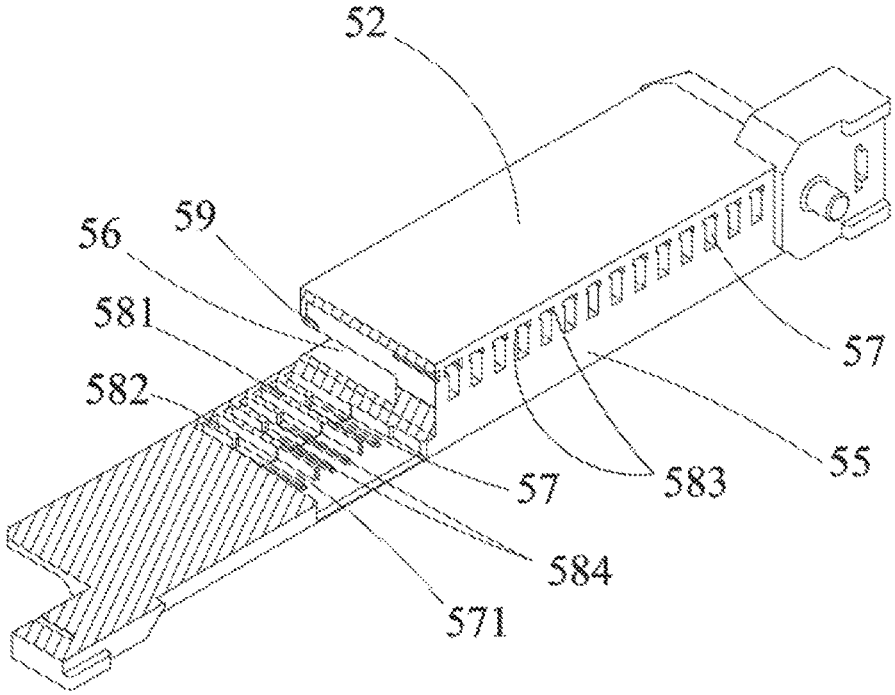
FIG. 6 is a cross-sectional view of portions of components of the embodiment of the present disclosure.
Figure 7:
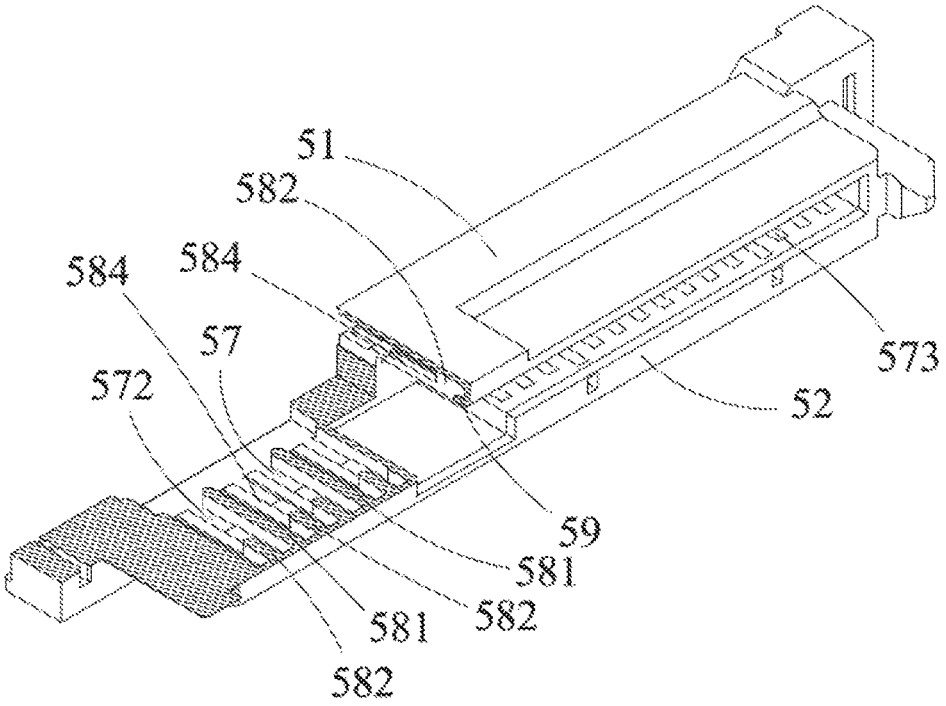
FIG. 7 is a cross-sectional view of portions of components of the embodiment of the present disclosure.
Figure 8:
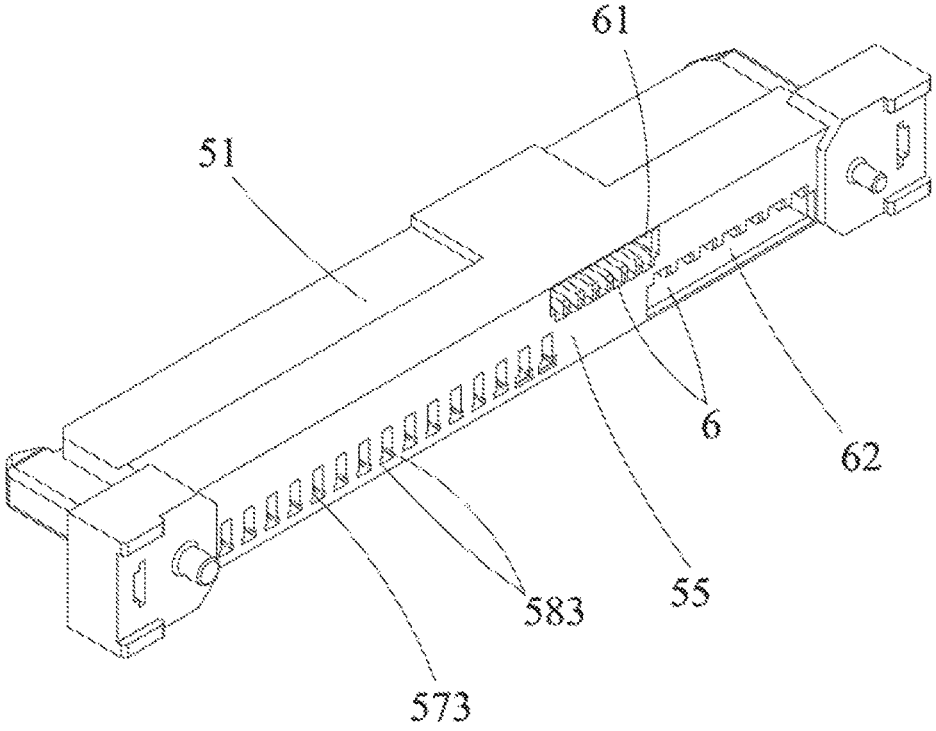
FIG. 8 is a perspective view of portions of components of the embodiment of the present disclosure.
Figure 9:
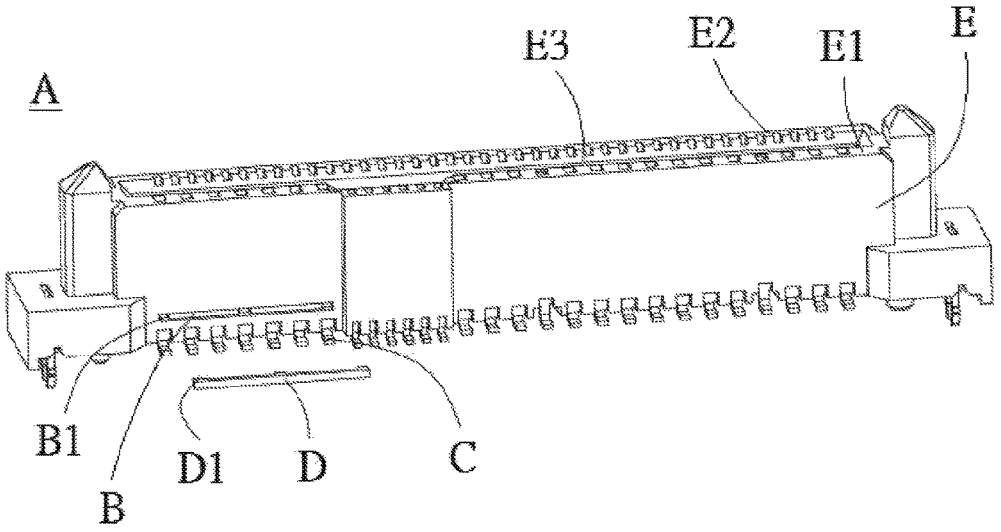
Fig. 9 (Prior Art)
FIG. 9 is a perspective view of a connector shown in a U.S. Pat. No. 9,281,589.

In the embodiment of the present disclosure, referring to FIG. 2, FIG. 6 and FIG. 8, the insulation casing 5 is made of plastic material. The insulation casing 5 includes a first side wall 51, a second side wall 52, a third side wall 53, a fourth side wall 54, and a bottom 55. The first side wall 51 and the second side wall 52 are oppositely disposed, and the third side wall 53 and the fourth side wall 54 are oppositely disposed. The third side wall 53 and the fourth side wall 54 are both connected to the first side wall 51 and the second side wall 52 and form an abutting cavity 56. The first side wall 51 and the second side wall 52 are respectively located on the two non-adjacent sides of the abutting cavity 56. The first side wall 51 and the second side wall 52 respectively includes a plurality of terminal slots 57. The bottom 55 closes one end of the abutting cavity 56 and the other end of the abutting cavity 56 has an opening 561 to be connected with the docking device. The bottom 55 is connected to the first side wall 51, the second side wall 52, the third side wall 53, and the fourth side wall 54. The bottom 55 includes at least one notch 6 that is open at the surface of the bottom 55. In this embodiment, the notch 6 includes a first notch 61 and a second notch 62, the first notch 61 and the second notch 62 are respectively independent and not communicated with each other In the embodiment of the present disclosure, referring to FIG. 6, FIG. 7 and FIG. 8, the terminal slots 57 are formed by a plurality of partition walls 58. The terminal slots 57 respectively include a plurality of first terminal slots 571, a plurality of second terminal slots 572, and a plurality of third terminal slots 573. The first terminal slots 571 respectively disposed on the first sidewall 51, the second terminal slots 572 and the third terminal slots 573 respectively disposed on the second sidewall 52. The terminal slots 57 respectively pass through the bottom 55 to allow the first terminal slots 571 to communicate with the first notch 61. The second terminal slots 572 communicate with the second notch 62. A partition wall 58 is disposed between two adjacent terminal slots 57. The partition walls 58 extend from the end of the opening 561 of the abutting cavity 56 toward bottom 55. The partition walls 58 is adjacent to the opening 561 of the abutting cavity 56 and has a supporting plate 59 for connecting with each other. The partition walls 58 are used to separate two adjacent terminal slots 57. The partition walls 58 provide accurate positioning of the conductive terminals 2 so as to reduce the interference between signals of the two adjacent conductive terminals 2.

Figure 4:
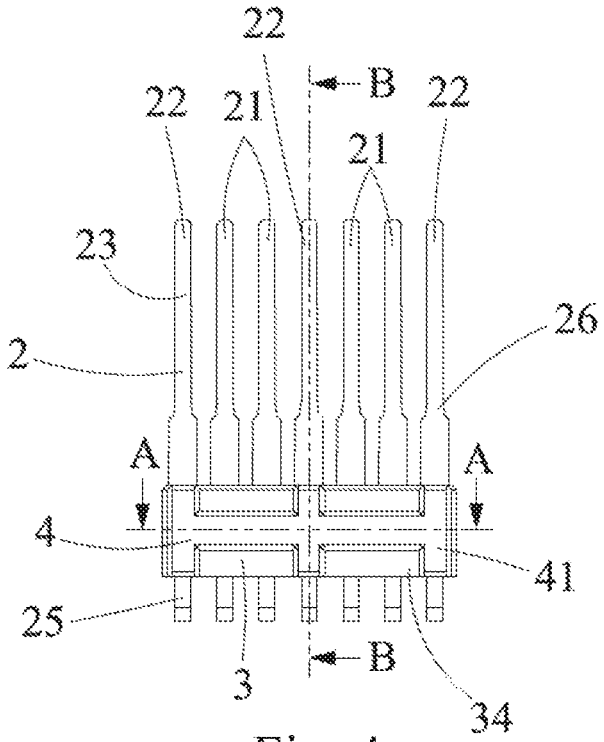
FIG. 4 is a top view of portions of components of the embodiment of the present disclosure.
Figures 2, 4:
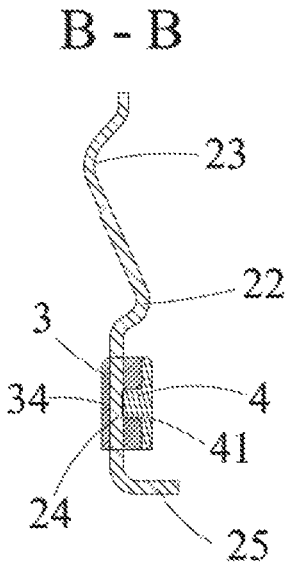
Figures 1, 4:
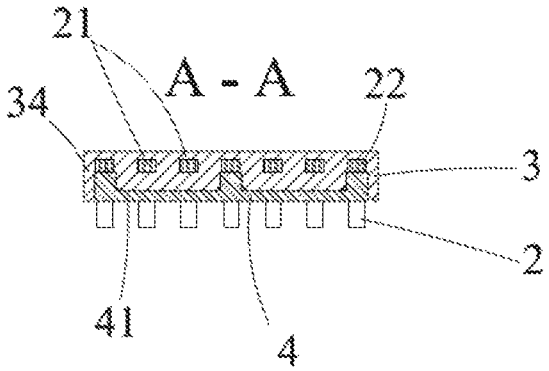

In the embodiment of the present disclosure, referring to FIG. 2, FIG. 4 and FIG. 6, the conductive terminals 2 of the first terminal group 26 are respectively mounted on the first terminal slots 571 of the first sidewall 51 by the first notch 61 of the bottom 55 corresponding to the first terminal slots 571. The front ends of the contact portions 23 of the conductive terminals 2 of the first terminal group 26 respectively abut against the supporting plate 59. The supporting plate 59 connects the partition walls 58 on the two sides of the first terminal slots 571, and the supporting plate 59 is adjacent to the opening 561 of the abutting cavity 56. The contact portions 23 protrude from the partition walls 58 on the first sidewall 51 respectively and extend into the abutting cavity 56. The first insulation body 34 is fixed in the first notch 61 of the bottom 55 corresponding to the first terminal slots 571. The soldering portions 25 extend out of the insulation casing 5 from the first insulation body 34. The soldering portions 25 can be fixed to the circuit board by a surface mount technology (SMT) or a dual in-line package (DIP) method. The first conductive portion 41 is sandwiched between the first sidewall 51 and the first insulation body 34. The first conductive portion 41 is stably fixed in the first insulation body 34 by the first sidewall 51 to reduce the risk of the first conductive portion 41 falling off.

Figures 1, 5:
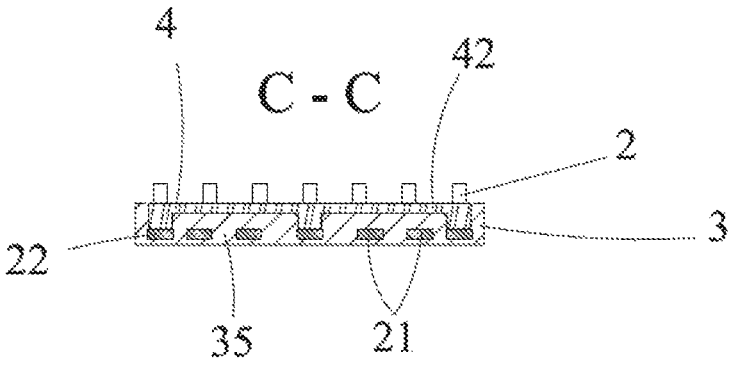
FIG. 5 is a bottom view of portions of components of the embodiment of the present disclosure.
Figure 5:
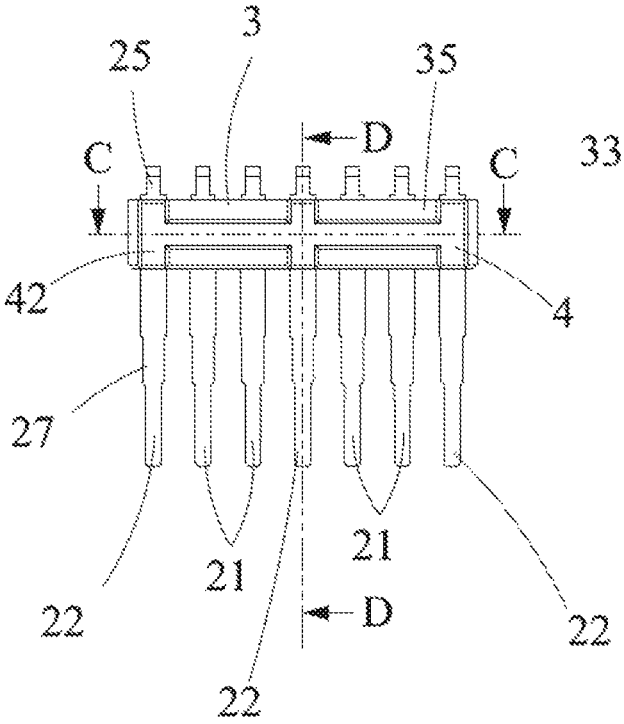
Figures 2, 5:
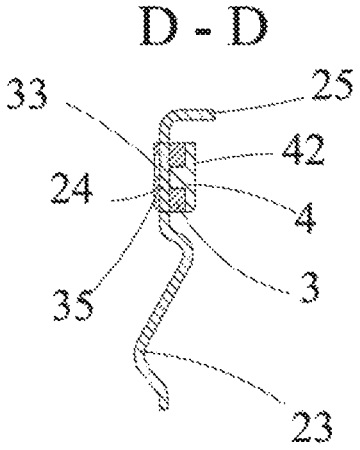

In the embodiment of the present disclosure, referring to FIG. 2, FIG. 7 and FIG. 5, the conductive terminals 2 of the second terminal group 27 are respectively mounted on the second terminal slots 572 of the second sidewall 52 by the second notch 62 of the bottom 55 corresponding to the second terminal slots 572. The front ends of the contact portions 23 of the conductive terminals 2 of the second terminal group 27 respectively abut against the supporting plate 59, and the supporting plate 59 connects the partition walls 58 on the two sides of the second terminal slots 572, and the supporting plate 59 is adjacent to the opening 561 of the abutting cavity 56. The contact portions 23 protrude from the partition walls 58 on the second sidewall 52 respectively and extend into the abutting cavity 56. The second insulation body 35 is fixed in the second notch 62 of the bottom 55 corresponding to the second terminal slots 572. The soldering portions 25 extend out of the insulation casing 5 from the second insulation body 35. The soldering portions 25 can be fixed to the circuit board by a surface mount technology (SMT) or a dual in-line package (DIP) method. The second conductive portion 42 which is connected to the grounding terminals 22 is fixed to the second insulation body 35. The second conductive portion 42 is sandwiched between the second sidewall 52 and the second insulation body 35. The second conductive portion 42 is stably fixed in the second insulation body 35 by the second sidewall 52 to reduce the risk of the second conductive portion 42 falling off.

In the embodiment of the present disclosure, referring to FIG. 4 and FIG. 5, the first terminal group 26 and second terminal group 27 respectively include two differential signal terminal pairs and three grounding terminals 22. A differential signal terminal pair is disposed between the two adjacent ground terminals 22, and insulation body 3 covers the main portions 24 of the differential terminal pairs and the grounding terminals 22. Since the insulation body 3 has a higher permittivity value than air permittivity, a large capacitance effect is likely to occur between two pairs of differential signal terminals coated in the insulating body 3, thereby affecting the impedance values of the conductive terminals 2. In order to maintain the impedance of the conductive terminals 2 consistent, capacitance is given by $C=\epsilon A/d$, which is obtained by solving Gauss's law, where C is the capacitance in parallel per unit length, $\epsilon$ is the permittivity of the dielectric in the capacitors, A is the area of the two plates in the capacitor, and d is the distance between the two plates in the capacitor. When the dielectric of the capacitor is changed, the capacitance value is also changed along with it. In this embodiment, the capacitance values of the conductive terminals 2 covered by the insulating bodies 3 are greater than the capacitance values of the conductive terminals 2 exposed in the air. In order to maintain the same capacitance value, in addition to the method of reducing the area of the opposing surfaces between the conductive terminals 2, the distance between the conductive terminals 2 may also be increased to improve the impedance vale caused by the difference in capacitance between the conductive terminals 2.

In the embodiment of the present disclosure, referring to FIG. 2, since the widths of the contact portions 23 of the conductive terminals 2 are smaller than the widths of the main portions 24, the distance between the contact portions 23 is greater than the distance between the main portions 24. Due to the greater distance between the contact portions 23, the capacitive effect generated is reduced when the high-frequency signal is transmitted. Grooves 33 are disposed on the surface of the second insulation body 35 of the second terminal group 27, and the corresponding conductive terminals 2 are exposed from the grooves 33 to contact air. Since the air has a lower permittivity than the second insulation body 35, the accumulation of charges of the main portions 24 covered by the second insulation body 35 is reduced, and the capacitive effect of the differential terminal signal pairs in the second insulation body 35 can be effectively reduced so as to maintain the impedance consistency of the conductive terminals 2. In other embodiments, the second terminal group 27 is not limited to the above-mentioned features. The first terminal group 26 may also adopt the above-mentioned features of expose the conductive terminals 2 to air by the grooves 33 of the insulation body 3 to reduce the problem of high-frequency interference.

In the embodiment of the present disclosure, referring to FIG. 3 and FIG. 8, the conductive terminals 2 of the third terminal group 28 are respectively inserted into the third terminal slots 573 through the openings of the third terminal slots 573 on the bottom 55. The front ends of the contact portions 23 of the conductive terminals 2 of the third terminal group 28 respectively abut against the supporting plate 59. The supporting plate 59 connects the partition walls 58 on the two sides of the third terminal slots 573, and the supporting plate 59 is adjacent to the opening 561 of the abutting cavity 56. The contact portions 23 protrude from the partition walls 58 on the second sidewall 52 respectively and extend into the abutting cavity 56. The widths of the main portions 24 are greater than the widths of the contact portions 23. The main portions 24 are respectively engaged with a pair of concave portions 583 on the two opposite surfaces of the partition walls 58 in the third terminal slots 573. The concave portions 583 are adjacent to the bottom 55. Each concave portion 583 includes at least one stepped structure to prevent the conductive terminals 2 from being separated backward or forward. The main portions 24 can be designed with barbs, and the barbs can be fixed to the partition walls 58 at both sides of the main portions to increase the frictional force of the conductive terminals 2, thereby preventing the conductive terminals 2 from being separated from insulation casing 5 by force. The soldering portions 25 extend out of the insulation casing 5 from corresponding main portions 24. The soldering portions 25 can be fixed to the circuit board by a surface mount technology (SMT) or a dual in-line package (DIP) method.

In the embodiment of the present disclosure, referring to FIG. 6 and FIG. 7, the partition walls 58 of the first side wall 51 and the second side wall 52 of the insulation casing 5 extend from the opening 561 adjacent to the abutting cavity 56 to the bottom 55 to form the first terminal slots 571 and the second terminal slots 572. The partition walls 58 include first partition walls 581 and second partition walls 582. The order of the conductive terminals 2 accommodated in the terminal slots 57 is (G-S-S-G-S-S-G). That is, each differential terminal signal pair is respectively disposed between the two grounding terminals 22 and only one grounding terminal 22 is provided between the two differential terminal signal pairs. The grounding terminals 22 provide the functions of shielding and separation respectively. A first partition wall 581 is disposed between the two signal terminals 21 of each differential signal pair. A second partition wall 582 is arranged between each signal terminals 21 and each grounding terminals 22. The first partition wall 581 completely separate the terminal slots 57 on its both sides, and the first partitioning walls 581 extend from the opening 561 of the abutting cavity 56 of the insulation casing 5 and abut the corresponding insulation body 3, such that the space between the terminal slots 57 on both sides of the first partition walls 581 are not communicated with each other.

The length of the second partition walls 582 is shorter than the first partition walls 581. The length of the second partition walls 582 is about one-third of the length of the first partition walls 581. Each second partition wall 582 includes a passageway 584, and the passageways 584 are located between the second partition wall 582 and the insulation body 3. The passageways 584 allow the space of the terminal slots 57 on two sides of each of the second partition walls 58 to communicate with each other. Through the passageways 584, the grounding terminals 22 can absorb and shield the noise and interference generated when the signal terminals 21 transmit high-frequency signals. Although the high-frequency signals transmitted by the two signal terminals 21 of the same differential signal terminals pairs have the same amplitudes, yet due to the opposite phases, the mutual interference can be effectively canceled. However, high-frequency interference still exists between the two differential terminal signal pairs. Therefore, the passageways 584 of the second partition walls 582 between the two differential signal terminal pairs expose the grounding terminals 22, respectively. The grounding terminals 22 absorb the noise and interference generated by the signal terminals 21, so as to reduce high-frequency interference between multiple pairs of differential terminal signal pairs and achieve better transmission quality of the electrical connector 1. The grounding terminals 22 are electrically connected to each other by using the conductive glue 4 so that the potential of each grounding terminal 22 is consistent.

In the embodiment of the present disclosure, the front end of the contact portion 23 of each conductive terminal 2 exerts a force on each of the supporting plates 59 corresponding to the first sidewall 51 and the second sidewall 52. The front ends of the contact portions 23 are constrained to the supporting plate 59, such that the contact portions 23 can only be elastically deformed in the direction opposite to the supporting plate 59, thus causing the contact portions 23 to be stressed by a pre-load provided by supporting plates 59 when the contact portions 23 are not docked with the docking device. When the electrical connector 1 is docked with the docking device, the contact portions 23 of each of the conductive terminals 2 can output a larger positive force, such that each of the contact portions 23 of the conductive terminals 2 and the docking device are connected closer with each other, thereby further stabilizing the signal transmission of the electrical connector 1.

Compared with the prior art, the present disclosure provides a further improvement on the design of the conductive terminals 2 of the electrical connector 1 for transmitting high-frequency signals. The ground terminals 22 are electrically connected to each other so that the potential of the grounding terminals 22 to reach consistent. Many connectors use metal grounding plates to connect the grounding terminals inside conventionally, and there may be large gaps between the grounding terminals and the metal grounding plates, thus affecting the grounding effect, causing the potential of the ground terminals to be inconsistent, and the metal grounding plates require additional process and consume more time and cost. In addition to the design of the metal grounding plate, the conventional connector also has the design of forming holes on the surface of the insulating casing into the conductive glue, in which the conductive glue is likely to fall off after the connector has been used repeatedly. In order to ensure the stability of the connector, the present disclosure uses the conductive glue 4, the insulation body 3, and the insulation casing 5 to achieve the purpose of connecting the conductive terminals 2 and fixing the conductive glue 4. Since technique of connecting the grounding terminals 22 of the conductive glue 4 is simple, the conductive glue 4 fills the openings 31 and the channel 32 of each insulation bodies 3 in a liquid state, and the grounding terminals 22 are respectively exposed to the openings 31. After the conductive glue 4 is cured, the grounding terminals 22 are electrically connected by conductive glue 4, the potentials of the grounding terminals 22 reach consistent, and the noise generated by the signal terminals 21 is shielded, and the insulation bodies 3 are touched closely to the insulation casing 5 each other, respectively. The conductive glue 4 is stably sandwiched between the insulation bodies 3 and the insulation casing 5 to prevent the conductive glue 4 from falling off caused by the repeated use of the electrical connector 1 and to provide the better reliability of the electrical connector 1 and further solve the problem of high frequency interference between the differential signal terminal pairs of the electrical connector 1.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An electrical connector, comprising:

a plurality of conductive terminals comprising a plurality of signal terminals and a plurality of grounding terminals, wherein each of the conductive terminals comprises a contact portion, a soldering portion, and a main portion connecting the contact portion and the soldering portion, and the conductive terminals comprise a first terminal group and a second terminal group;

a plurality of insulation bodies comprising a first insulation body and a second insulation body, wherein the first insulation body is fixed to each main portion of the first terminal group, the second insulation body is fixed to each main portion of the second terminal group, and the insulation bodies has a plurality of openings exposing the corresponding grounding terminals;

a conductive glue fixed in the openings of the insulation bodies to electrically connect the grounding terminals to each other; and an insulation casing comprising a first side wall, a second side wall and a bottom defining a abutting cavity, wherein the first side wall and the second side wall are respectively located on two sides of the abutting cavity which are not adjacent to each other, the first side wall and the second side wall comprise a plurality of terminal slots, the terminal slots comprise a plurality of first terminal slots that are disposed on the first side wall and a plurality of second terminal slots that are disposed on the second side wall, the bottom has at least one notch communicating with the terminal slots, wherein the first terminal group is disposed on the first terminal slots of the first side wall, the second terminal group is disposed on the second terminal slots of the second side wall, and the insulation bodies are fixed to the notch corresponding to the bottom.

2. The electrical connector of claim 1, wherein each of the insulation bodies has at least one channel, the channel is a groove structure formed on a surface of the insulation bodies, the openings are located in the channel, and the conductive glue is fixed to the channel and the openings.

3. The electrical connector of claim 2, wherein each of the channels comprises a plurality of parallel sections and a vertical section, the parallel sections are parallel to the conductive terminals, and the vertical section is connected to the parallel sections and is perpendicular to the conductive terminals, wherein the openings are respectively located in the parallel sections.

4. The electrical connector of claim 1, wherein the conductive glue is connected to the grounding terminals by bridging.

5. The electrical connector of claim 1, wherein the conductive glue is sandwiched between the insulation bodies and the insulation casing.

6. The electrical connector of claim 1, wherein the conductive glue is in physical contact with the grounding terminals or spaced apart from the grounding terminals by a tiny distance.

7. The electrical connector of claim 1, wherein the notch is independently located in the bottom and does not communicate with another notch.

8. The electrical connector of claim 1, wherein the terminal slots of the insulation casing are separated by a plurality of partition walls, the partition walls comprises a plurality of first partition walls and a plurality of second partition walls, the first partition walls are sandwiched between two adjacent signal terminals, and the second partition walls are sandwiched between the signal terminals and grounding terminals that are adjacent to each other.

9. The electrical connector of claim 8, wherein the second partition walls are shorter in length than the first partition walls, and each of the second partition walls has a passageway for connecting space of the terminal slots on two sides of the second partition walls.

10. The electrical connector of claim 1, wherein a cross-sectional area of each of the contact portions of the conductive terminals is smaller than a cross-sectional area of each of the main portions of each of the conductive terminals.

* * * * *